US005940100A

United States Patent [19]

Colombat

[11] Patent Number: 5,940,100

[45] Date of Patent: Aug. 17, 1999

[54] DEVICE PERMITTING THE EMISSION OF A STIMULATED JET OF PRESSURIZED MATERIAL THROUGH A SEALABLE NOZZLE

[75] Inventor: Thierry Colombat, La Voulte, France

[73] Assignee: Imaje S.A., Cedex, France

[21] Appl. No.: 08/816,565

[22] Filed: Mar. 13, 1997

[30] Foreign Application Priority Data

Mar. 14, 1996 [FR] France ..... 96 03222

[51] Int. Cl.[6] ..... B41J 2/03

[52] U.S. Cl. ..... 347/75; 347/29

[58] Field of Search ..... 347/75, 29

[56] References Cited

U.S. PATENT DOCUMENTS

| | | | |
|---|---|---|---|
| 4,199,767 | 4/1980 | Campbell et al. | 347/44 |
| 4,576,111 | 3/1986 | Slomianny | 118/313 |
| 4,703,330 | 10/1987 | Culpepper | 347/75 |
| 4,723,131 | 2/1988 | Droit | 347/54 |
| 5,424,768 | 6/1995 | Dudek et al. | 347/29 |
| 5,457,484 | 10/1995 | Regnault et al. | 347/74 |
| 5,598,197 | 1/1997 | Zaba | 347/75 |

FOREIGN PATENT DOCUMENTS

| | | |
|---|---|---|
| 0054905 | 6/1982 | European Pat. Off. . |
| 2540044 | 1/1984 | France . |
| 2653063 | 4/1991 | France . |
| 91 00808 | 1/1991 | WIPO . |

OTHER PUBLICATIONS

Patent Abstracts of Japan, vol. 95, No. 012, & JP 07 314703 A (Dainippon Screen Mfg Co Ltd), Dec. 5, 1995.

*Primary Examiner*—N. Le
*Assistant Examiner*—Lamson D. Nguyen
*Attorney, Agent, or Firm*—Pearne, Gordon, McCoy & Granger LLP

[57] ABSTRACT

A device permitting the emission or discharge of material in the form of a jet by a nozzle, which is able to communicate with a cavity of the device through which the material passes and where it is pressurized in order to permit the formation of the jet under the effect of a controller. A stimulator is located in the vicinity of the nozzle in order to split up the jet into a succession of elements. The device includes a seal for the nozzle when no material jet is being discharged made of a deformable member placed between the stimulator and the nozzle and designed and positioned so as to seal the nozzle when the controller does not allow the emission of a material jet and to free the nozzle when the controller allows the emission of a jet.

10 Claims, 3 Drawing Sheets

DEVICE PERMITTING THE EMISSION OF A STIMULATED JET OF PRESSURIZED MATERIAL THROUGH A SEALABLE NOZZLE

BACKGROUND OF THE INVENTION

The present invention relates to a device permitting the emission or discharge of a stimulated pressurized material jet through a sealable nozzle. Such a device can be more particularly used for producing printing heads of ink jet printers.

Thus, ink jet printers, as is indicated by the name, produce ink jets or droplets with the aid of ejection nozzles. The control of the ink pressure upstream of the nozzle makes it possible to start or stop the fluid flow through the nozzle orifice. The quality of the stops and starts is essentially dependent on the duration of the pressure transients during these phases. A complete transition of pressure values permits the obtaining of a good directivity of the jet on starting and avoids the formation of ink deposits at the nozzle outlet when the jet is stopped.

The passage from the stop mode to the printing mode causes certain problems, namely:

- the repeatability of the transient phases, which is difficult to obtain with conventional control means on the pressure circuit formed by solenoid valves,
- the flow of fluid through the nozzle after stopping disturbs the rapid stabilization of the jet and when the ambient temperature evolves, the ink between the nozzle and the solenoid valve can expand and give rise to a fluid flow through the nozzle, which will be prejudicial to the restarting of the jet,
- the use of rapid drying inks leads to a clogging of the nozzle following a prolonged stoppage.

Different solutions have been proposed for obviating these deficiencies. One of these solutions consists of sealing the nozzle between two operating phases.

It is possible to summarize the solutions proposed in order to obviate the risk of clogging of nozzles by referring to the following documents.

EP-A-54 905 describes the use of an electromagnetic closing means for the jet emitting nozzle for ensuring that ambient air does not enter it and applies to the case where the printing ink is a magnetic fluid. An explanation is given how the problems of the supply circuit for a magnetic fluid are solved.

U.S. Pat. No. 4,199,767 describes a nozzle sealing means constituted by a plate able to move in front of the nozzle by means of a magnetic field. A similar idea is disclosed in IBM Technical Disclosure Bulletin, vol. 18, No. 12, May 1976. In the proposed systems, which contact two solid parts in order to seal an orifice, it is still necessary to provide adequate electromagnetic forces for separating the contacts following a prolonged stoppage, because an ink residue has been able to dry around said contacts.

FR-A-2 250 044 describes a nozzle sealing solution using solenoid valves equipped with a flexible part mounted on the rod of a translation element. This function is used for generating droplets at the frequency of nozzle opening and closing. This solution is taken up again in WO 91/00808 in the case of using deflected continuous jet technology. In this case, the electromagnetically controlled translation element bears on the nozzle by means of a flexible part and isolates the ink from the ambient medium during stoppages. This solution avoids the flow of ink and the drying thereof on leaving the nozzle. Moreover, the nozzle is opened when the ink cavity is under an established pressure and thus permits a rapid, stable starting of the jet. The trapping of air in the cavity at the time of stoppage is avoided and there is no air/ink atomization phenomenon at the time of starting the jet. However, this solution suffers from a serious disadvantage due to the space occupied through the housing of on the one hand the jet stimulation actuator and on the other the sealing assembly. The cavity upstream of the nozzle must receive these two functions either coaxially, or according to two separate axes converging towards the nozzle.

BRIEF SUMMARY OF THE INVENTION

In order to obviate the disadvantages of these prior art devices, the present invention proposes the installation of a nozzle sealing means having the special feature of being associated with the stimulation function of the device. The device according to the invention has the advantage of being compact. It ensures the correct sealing of the nozzle whilst guaranteeing correct and repeatable jet stoppages and starts. A supplementary advantage is the reduced number of parts necessary for its construction.

The invention therefore relates to a device permitting the emission of material in the form of a jet by means of a nozzle having at least one emission orifice, the nozzle being able to communicate with a cavity of the device through which passes said material and where it is pressurized to permit the formation of said jet under the action of control means, stimulation means being located in the vicinity of the nozzle in order to split up the jet into a succession of elements, means for sealing the nozzle in the absence of material jet emission being provided, characterized in that the sealing means are constituted by a deformable member positioned between the stimulation means and the nozzle and integral with said stimulation means, the deformable member being mechanically designed as a function of the pressure to which said material is exposed, so as to have the following bistable operation:

- being in a nozzle sealing position when the control means do not allow the emission of a material jet,
- being in a nozzle freeing position when the control means allow the emission of a material jet.

In the case where the emission of a jet is controlled by the pressure existing in the cavity, the deformable member comprises a part located between the stimulation means and the nozzle, said part being connected to a bellows authorizing a relative displacement of said part with respect to the nozzle, the bellows, exposed on one of its faces to the pressure of the material in the cavity, having mechanical characteristics such that for a pressure of the material not allowing the emissive of a jet, said part of the deformable member seals the nozzle, and for a pressure of the material allowing the emission of a jet, said part of the deformable member is moved away from the nozzle.

The stimulation means can incorporate an elongated body, the bellows surrounding the elongated body and being tightly fixed to said elongated body, so that the space between the elongated body, the bellows and the part of the deformable member contains a gas, which can be air.

Advantageously, when the emission of a jet is not allowed, said part of the deformable member is engaged against the nozzle, sealing means being provided between said part and the nozzle.

According to another variant, the control means can comprise an actuator acting on the deformable member in order to seal or free the nozzle. This actuator can also serve as a jet stimulation means.

The actuator can advantageously be a piezoelectric or electromagnetic element having means for receiving a d.c. voltage in order to force the deformable member to free the nozzle and an a.c. voltage permitting jet stimulation.

According to a preferred development of said variant, the nozzle can be contained in a nozzle plate, the deformable member can be a membrane held in the device by its periphery, the nozzle plate, the membrane and the actuator forming a succession of stacked elements centred on the nozzle, the nozzle plate having one of its main faces in contact with a supply pipe for said material and the other of its main faces adjacent to the membrane, a communication being provided between the two main faces of the nozzle plate for the passage of said material.

The invention is described in greater detail hereinafter relative to an ink jet printer printing head, although it is also applicable to the emission of a stimulated jet of another material. The invention can be better understood by referring to the attached drawings, wherein show:

DETAILED DESCRIPTION OF THE INVENTION

Figure 1:
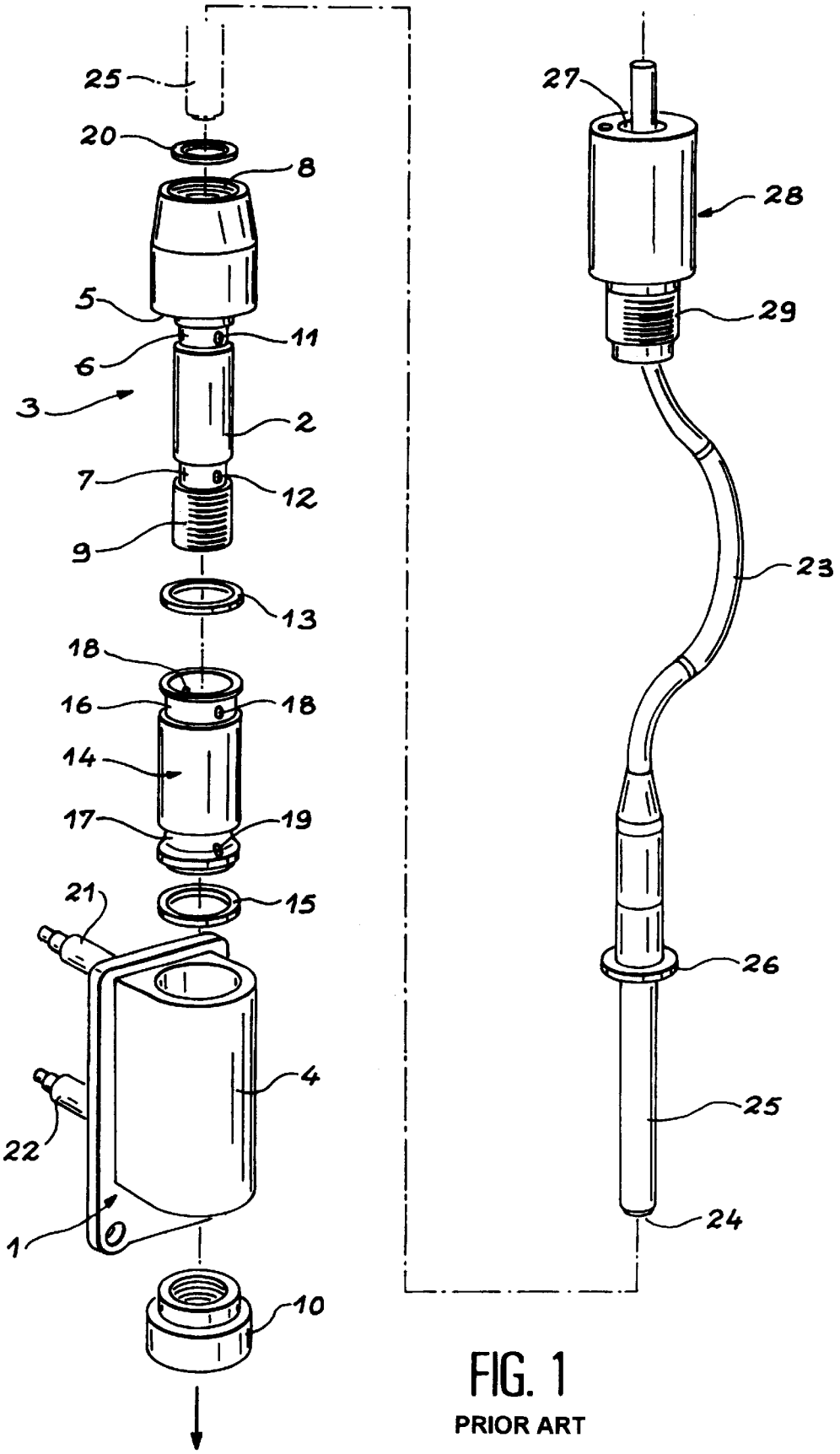
FIG. 1 PRIOR ART
FIG. 1 An exploded view of a stimulating or modulating device for a prior art ink jet printing head.

The solution proposed by the invention will now be applied to the modulating device disclosed by FR-A-2 653 063. This device is shown in exploded form in FIG. 1, the elements shown in the right-hand part of the drawing normally being located in the extension of the upper, left-hand part.

The device has a support 1 to be fixed to the mechanical structure of the printing head (cf. FIG. 1 of FR-A-2 653 063). The support 1 has a tubular part 4, whose axis coincides with the ink jet axis. In said tubular part 4 is housed the body 2 of the gun 3, which is a generally cylindrical part, whose axis of revolution coincides with the axis of the tubular part 4. The gun 3 is completely traversed by an axial hole 8.

The body 2 constitutes the lower part of the gun 3. A shoulder 5 constitutes the separation between the body 2 and the upper part of the gun 3. The body 2 has an upper groove 6 close to the shoulder 5 and a lower groove 7. The lower end 9 of the body 2 is threaded in order to receive the nut 10. Radial holes 11, 12 respectively made in the grooves 6, 7 ensure the communication between the axial hole 8 and the grooves 6, 7.

Before engaging the gun body 2 in the tubular part 4 of the support 1, onto the body 2 are successively threaded the ring joint 13, the tubular spacer 14 and the rink joint 15. The mean diameters of the joints 13 and 15 correspond to the diameter of the spacer 14, so that joint 13, spacer 14 and joint 15 form a stack.

With the body 2 of the gun 3, equipped with the joint 13, the spacer 14 and the joint 15, introduced into the tubular part 4, the nut 10 is screwed onto the end 9 of the body 2 through the lower orifice of the tubular part 4. The joint 13 abuts against the shoulder 5 of the gun and the force exerted by the nut 10 during screwing on the joint 15 has repercussions on the joint 13 via the spacer 14. The joints 13 and 15 can be expanded under the effect of a force. The tightening of the nut 10 consequently brings about the application of the joints 13 and 15 to the inner wall of the tubular part 4, thus ensuring both the sealing at the joints and the fixing of the gun 3 to the support 1. It is pointed out that the nut 10 does not bear on the tubular part 4 of the support. Its action is only exerted on the stack constituted by joint 13, spacer 14 and joint 15.

The spacer 14 has an upper groove 16 and a lower groove 17. Holes 18 and 19 are made radially and respectively in grooves 16 and 17.

On installation, the grooves 16, 17 of the spacer 14 face the respective grooves 6, 7 of the body 2.

The support 5 is provided with a coupling 21 for introducing pressurized ink into the tubular part 4 and a coupling 22 permitting the purging of said same tubular part. These couplings 21 and 22 issue in the vicinity of grooves 16 and 17 of spacer 14.

The resonator 25 permitting the stimulation of the ink jet is introduced by its end 24 into the gun 3 through the upper orifice of the hole 8, through the joint 20. The other end of the resonator is extended by an electric cable 23 to an external control member. The cable 23 passes into the axial hole 27 of the flange 28.

The fixing of the resonator in the gun takes place in the following way. The resonator 25 equipped with the joint 20 is driven into the hole 8 until the lower face of the joint 20 abuts against a shoulder provided in the hole 8. A collar 26 of the resonator then abuts on the upper face of the joint 20. The flange is slid along the cable 23 and its lower threaded part 29 is screwed into the upper, lapped part of the hold 8 until it presses the sealing joint 20.

The device functions as follows. The pressurized ink injected via the coupling 21 immerses the exterior of the spacer 14 and penetrates through the holes 18 so as to reach the outer part of the gun body 2. The ink passes into the holes 11 of the groove 6. penetrates the interior of the gun immersing the resonator 25 and is directed towards the gun end 9, being terminated by a washer (not visible in FIG. 1) in which there is an axial hole serving as an ink emission nozzle. The purging of the device takes place by ink return, by means of the holes 12, in the tubular space between the body 2 and the spacer 14 and then, by means of the spacer holes 19, in the tubular space between the spacer 14 and the tubular part of the support. The ink is then discharged by the coupling 22.

The ink jet stimulated by the resonator 25 therefore passes along the axis of the device, as is indicated by the arrow under the nut 10.

Lateral holes provided in the nut 10, gun 3 and flange 28 enable settings to be made in order to obtain a good alignment of the ink jet. These settings are explained in FR-A-2 653 063.

Figure 2:
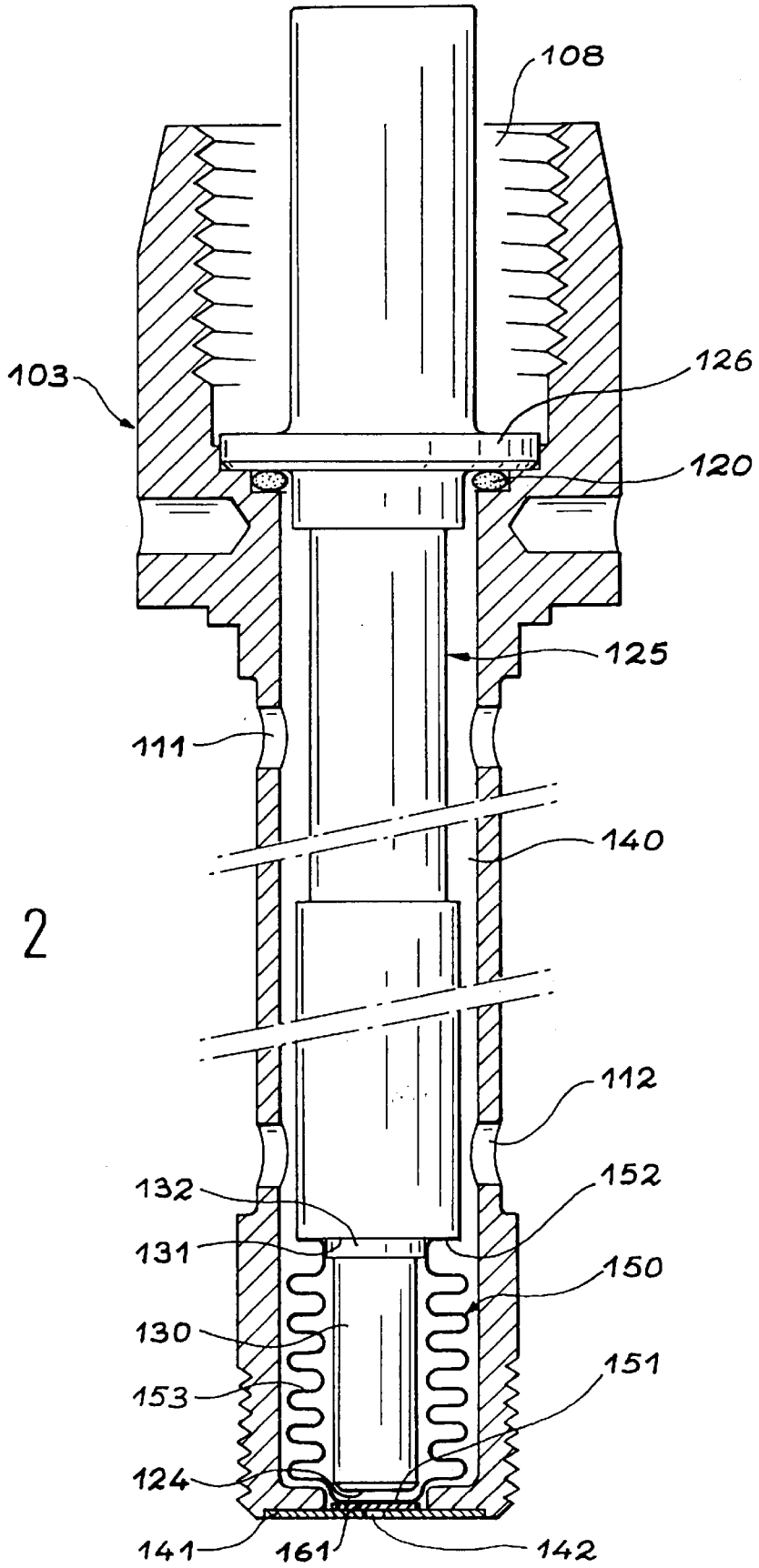
FIG. 2 A longitudinal sectional view of the gun of the modulating device equipped with its resonator and in which is implemented the present invention.

FIG. 2 shows a gun 103 of a modulating device in which is housed a modulator 125, said elements being of the type shown in FIG. 1. The modulator 125 rests on an inner shoulder of the gun 103 by means of the collar 126 with the interposing of a sealing joint of packing 120. It has an end part 130 of smaller diameter than the remainder of the modulator, which leads to the presence of a shoulder 131. A collet 132 connects the end part 130 to the remainder of the modulator.

Between the resonator 125 and the gun 103 is provided a cavity 140 constituting part of the axial hold 108 of the gun and in which can circulate ink introduced through the hole 111 and which can be discharged by the hole 112. The ink is exposed to the action of the resonator 125 in the cavity 140.

To the lower end of the gun 103 is fixed a disk-like plate 141 provided with a central hole 142 forming the nozzle. The nozzle 142 faces the lower end 124 of the resonator 125.

According to the invention, a deformable member 150 is placed between the resonator 125 and the nozzle 142. The deformable member 150 has a disk-shaped part 151, whose diameter corresponds to the diameter of the end part 130 of the resonator, an annular part 152 for connection to the resonator and an intermediate part 153 serving as a bellows and surrounding the end part 130 of the resonator. The resonator collet 132 makes it possible to easily centre the deformable member 150 on the end part 130. This deformable member can be of stainless steel and can be fixed by tight welding to the resonator. Thus, an air volume is trapped between the deformable member 150 and the end part 130 of the resonator.

A sealing washer 161 of elastomer or Teflon, fixed to the outside of the disk-shaped part 151, constitutes a flexible interface between the deformable member and the plate 141. In place of a washer, use can be made of a coating, e.g. of fluorine polymer, on the outside of said part 151.

In the application example shown in FIG. 2, the nozzle sealing means is of the passive type. It is actuated by means of different pressures established in the gun during the stop and start phases. The bellows 153 has a useful travel permitting a bistable operation of the sealing means. In a first state, the prestressed bellows rests on the plate 141, which brings about the sealing of the nozzle.

In a second state, the bellows 153 is compressed under the action of the nozzle rise of the ink 140 until the deformable member part 151 bears against the resonator end 124, which constitutes the starting phase. The nozzle 142 is freed to communicate with the cavity 140 so the ink can be emitted in the form of a jet.

This arrangement permits the starting and stopping of the jet at well controlled pressure values by acting on the following parameters: mechanical stiffness of the bellows, closing prestressing value, effective surface of the bellows. For example, the bellows can be constituted by a 20 $\mu$m thick, stainless steel sheet.

The optimum bellows dimensioning ensures, as a function of the open or closed states of the solenoid valves of the ink circuit, the following cycles:

- jet stopping: complete stoppage of the jet at the chosen pressure value and rapid pressure drop in the cavity 140 by opening the purge solenoid valve during the closing of the pressure solenoid valve,
- renewing ink: opening the purge solenoid valve and then the pressure solenoid valve makes it possible to renew the ink, the nozzle being sealed (operating pressure below the bellows opening threshold),
- starting the jet: closing the purge solenoid valve during the renewing phase brings about a sudden pressure rise in the cavity 140 and separates the bellows from the nozzle plate 141 at a clearly defined pressure value.

Figure 3:
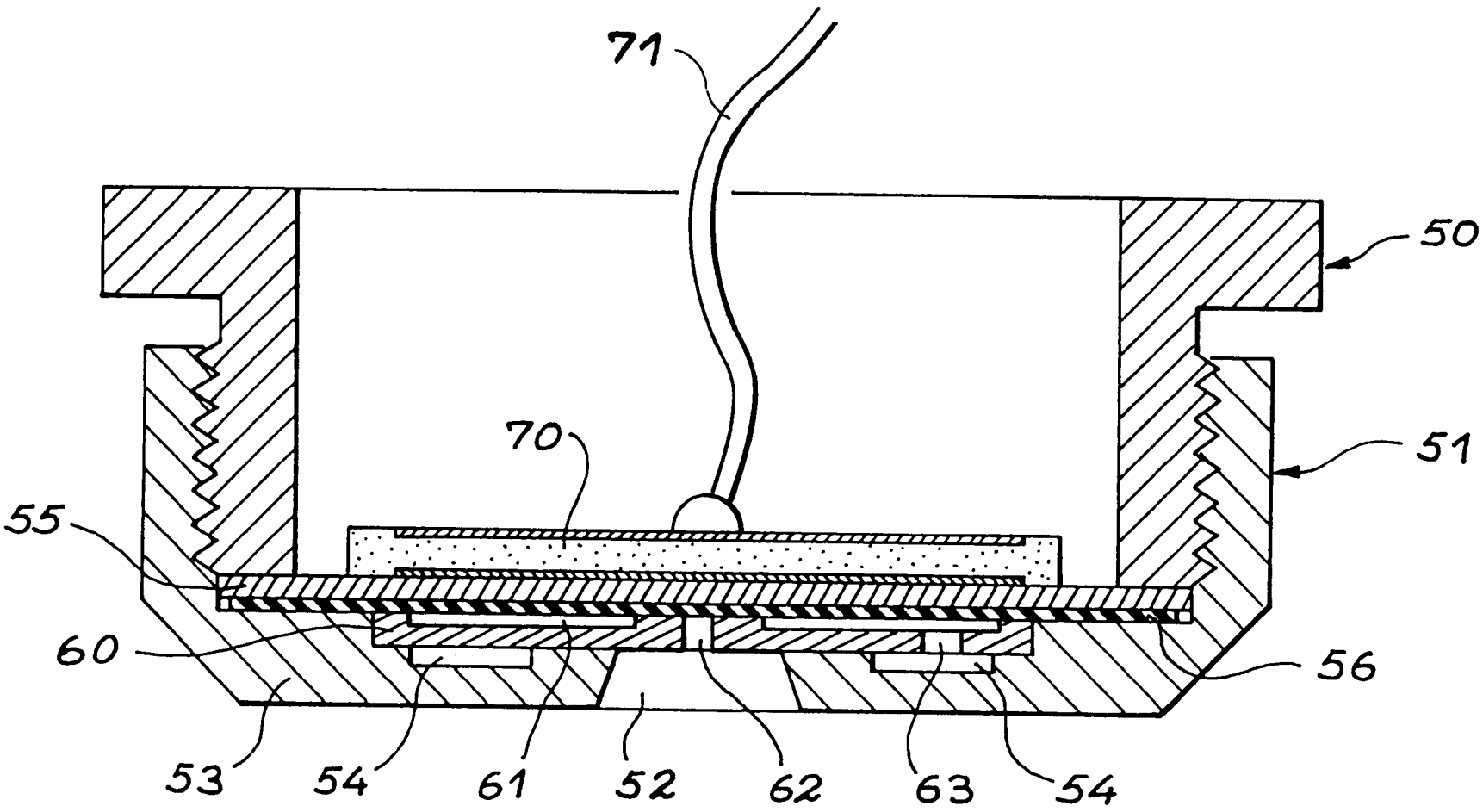
FIG. 3 An element of another variant of the modulating device implementing the present invention.

Another variant of the ink jet modulating device is shown in FIG. 3. Said device is fixed to an ink jet printing press with the aid of a flange 50 and has a cylindrical body 51 screwed to said flange. As a variant, the device can be fixed to the press by the cylindrical body 51. A disk-shaped nozzle plate 60 e.g. obtained by chemical cutting and etching is located in an appropriately shaped recess located in the bottom 53 of the body 51. In the bottom 53 is provided a central hole 52 and there is an annular, ink supply pipe 54 communicating with an ink circuit equipped with not shown pressure and purge valves. The nozzle plate 60 has an annular pipe 61 directed upwards and is provided with a central hole 62 forming an ejection nozzle, as well as holes 63 (only one being visible in the drawing) linking the annular pipes 34 and 61. The volume constituted by the pipes 54 and 61 and by the communication holes 63 forms the equivalent of a cavity.

The nozzle plate 60 is covered by a metal membrane 55 serving as a sealing means, a flexible film 56 (e.g. of elastomer) being interposed between the membrane 55 and the nozzle plate 60 for sealing purposes. The membrane 55 and flexible film 56 are disk-shaped elements held on their periphery by the tightening resulting from the screwing of the body 51 onto the flange 50.

A piezoelectric actuator 70 is rendered integral with the membrane 55 and receives electric control signals by the electric cable 71. As a variant, an electromagnetic actuator could be used.

The operation of the device shown in FIG. 3 is identical to that of FIG. 2. The stiffness of the installation ensures the two stable positions at clearly defined pressure values. A d.c. voltage can be supplied to the actuator 70 to permit the raising of the membrane 55 and the flexible sealing film 56 adhering thereto, thus freeing the nozzle in order to bring about the discharge of an ink jet. The application of said d.c. voltage makes it possible to obtain more complete pressure transients. The d.c. voltage can be positive or negative to aid the opening or closing of the nozzle. An a.c. voltage on which is possible superimposed the d.c. voltage makes it possible to vibrate the metal membrane 55 and split up the ink jet into a succession of droplets. During the emission of a jet, the d.c. voltage offers the possibility of modifying the ink flow by modifying the voltage value, so that jet speeds can be regulated.

This arrangement has the advantage of compactness, whilst limiting the number of components needed in order to be functional.

The following advantages are inter alia obtained by the invention:

- the prevention of jet instability during the renewing and stopping phases avoiding jet pressure surges in operation,
- the correct stopping and starting of the jet by ensuring the opening and closing of the nozzle at known and repeatable pressure values,
- the elimination of starting of an atomization of air and ink by avoiding the introduction of air into the cavity,
- keeping clean the outlet of the nozzle by avoiding ink flows on stopping.

I claim:

1. A device permitting emission of material in a form of a jet comprising:

- a cavity through which passes said material, the material being pressurized in the cavity;
- a control means for controlling pressurization of the material in the cavity to allow emission of a material jet;
- a nozzle having at least one emission orifice able to communicate with the cavity;
- stimulation means located adjacent the nozzle in order to split up the jet into a succession of elements; and
- means for sealing the nozzle comprising a deformable member having a part positioned between the stimulation means and the nozzle and integral with the stimulation means, the deformable member being operable by a pressure to which said material is exposed so as to have a bistable operation comprising:

a nozzle sealing position when the control means does not allow emission of a material jet, and a nozzle freeing position when the control means allows the emission of a material jet.

2. The device according to claim 1, wherein the part of the deformable member positioned between thee stimulation means and the nozzle is connected to a bellows allowing a displacement of said part with respect to the nozzle, wherein the bellows is exposed on one face to pressure of the material in the cavity such that the pressure acts on the bellows causing said part of the deformable member to seal the nozzle at a pressure of the material not allowing emission of a jet, and causing said part of the deformable member to move away from the nozzle at a pressure of the material allowing emission of a jet.

3. The device according to claim 2, wherein the stimulation means have an elongated body, the bellows surrounds the elongated body and is tightly fixed to said elongated body to provide a space between the elongated body, the bellows and the deformable member part, wherein the space contains a gas.

4. Device according to claim 3, wherein the gas contained in said space is air.

5. The device according to claim 2, wherein, when the emission of a jet is not allowed, said deformable member part is engaged on the nozzle, sealing means being provided between said part and said nozzle.

6. The device according to claim 1, wherein the control means comprise an actuator acting on the deformable member in order to seal or free the nozzle.

7. The device according to claim 6, wherein said actuator also serves as a jet stimulation means for stimulating the jet.

8. The device according to claim 7, wherein said actuator is a piezoelectric or electromagnetic element having means for receiving a d.c. voltage in order to force the deformable member to free the nozzle and an a.c. voltage permitting the stimulation of the jet.

9. The device according to claim 6, wherein the nozzle is contained in a nozzle plate, the deformable member is a membrane having its periphery maintained in the device, the nozzle plate, membrane and actuator form a succession of stacked elements centered with respect to the nozzle, the nozzle plate has a main face in contact with a supply pipe for said material and another main face adjacent to the membrane, and a communication is provided between the two main faces of the nozzle plate for the passage of said material.

10. The device according to claim 9, wherein a flexible sealing film is interposed between the membrane and the nozzle plate.

* * * * *

UNITED STATES PATENT AND TRADEMARK OFFICE

CERTIFICATE OF CORRECTION

PATENT NO. : 5,940,100

DATED : August 17, 1999

INVENTOR(S) : Colombat

It is certified that error appears in the above-identified patent and that said Letters Patent is hereby corrected as shown below:

Column 1, Line 57, delete "FR-A-2 250 044" and insert --FR-A-2 540 044--.

Column 3, Line 59, delete "rink" and insert --ring--.

Column 5, Line 35, delete "nozzle" and insert --pressure--.

Column 6, Line 9, delete "34" and insert --54--.

Column 7, Line 10, Claim 2, delete "thee" and insert --the--.

Column 7, Line 26, Claim 4, delete "Device" and insert --The device--.

Column 8, Line 1, Claim 5, after "nozzle," insert --and further comprising--.

Signed and Sealed this

Twenty-eighth Day of December, 1999

*Attest:*

Q. TODD DICKINSON

*Attesting Officer*

*Acting Commissioner of Patents and Trademarks*